US006387479B1

(12) United States Patent
Hayashi et al.

(10) Patent No.: US 6,387,479 B1
(45) Date of Patent: May 14, 2002

(54) METHOD OF REPAIRING/REINFORCING EXISTING STRUCTURES AND ANISOTROPIC WOVEN FABRICS USED THEREFOR

(75) Inventors: Shigetsugu Hayashi; Masahiro Sugimori; Tomowo Sano; Tadashi Yokochi; Masayuki Fukumoto; Yasushi Suzumura; Hideo Konishi; Toshikazu Aoki; Mikio Takasu, all of Nagoya (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 09/065,098

(22) PCT Filed: Nov. 1, 1996

(86) PCT No.: PCT/JP96/03208

§ 371 Date: Apr. 29, 1998

§ 102(e) Date: Apr. 29, 1998

(87) PCT Pub. No.: WO97/16602

PCT Pub. Date: May 9, 1997

(30) Foreign Application Priority Data

| | | |
|---|---|---|
| Nov. 1, 1995 | (JP) | 7-284751 |
| Nov. 1, 1995 | (JP) | 7-284752 |
| Feb. 20, 1996 | (JP) | 8-032473 |
| Feb. 26, 1996 | (JP) | 8-038048 |
| Sep. 13, 1996 | (JP) | 8-243495 |
| Sep. 13, 1996 | (JP) | 8-243496 |
| Oct. 7, 1996 | (JP) | 8-265940 |

(51) Int. Cl.[7] ..... B32B 27/04; B32B 27/12

(52) U.S. Cl. ..... 428/297.4; 428/112; 428/114; 156/94

(58) Field of Search ..... 428/114, 112, 428/297.4; 150/94

(56) References Cited

U.S. PATENT DOCUMENTS

| | | | | | |
|---|---|---|---|---|---|
| 4,083,890 | A | * | 4/1978 | Drake et al. | 260/836 |
| 4,568,589 | A | * | 2/1986 | Briggs | 428/63 |
| 4,824,500 | A | * | 4/1989 | White et al. | 156/94 |
| 5,219,642 | A | * | 6/1993 | Meakin et al. | 428/212 |
| 5,326,410 | A | * | 7/1994 | Boyles | 156/71 |
| 5,554,672 | A | * | 9/1996 | Saito et al. | 523/466 |
| 6,063,839 | A | * | 5/2000 | Oosedo et al. | 523/206 |
| 6,103,779 | A | * | 8/2000 | Guzauskas | 523/115 |

FOREIGN PATENT DOCUMENTS

| | | |
|---|---|---|
| JP | 62-6932 | 1/1987 |
| JP | 3-234522 | 10/1991 |
| JP | 4-149366 | 5/1992 |
| JP | 6-298167 | 10/1994 |
| JP | 8-118351 | 5/1996 |
| JP | 8-118535 | 5/1996 |
| JP | 8-142238 | 6/1996 |
| JP | 9-132852 | 5/1997 |

* cited by examiner

*Primary Examiner*—Blaine Copenheaver
*Assistant Examiner*—Christopher C. Pratt
(74) *Attorney, Agent, or Firm*—Oblon, Spivak, McClelland, Maier & Neustadt, P.C.

(57) ABSTRACT

The present invention relates to a repair and reinforcement method for preexisting structures such as buildings or the like, and in particular, relates to a repair and reinforcement method for concrete structures, and to an anisotropic textile employed in this method. The present invention provides a method which permits execution even in low temperature conditions, and which moreover exhibits superior repair and reinforcement effects in a short period of time; during the impregnation of a resin into a sheet material comprising reinforcement fibers and the curing of this resin to form a fiber-reinforced resin layer which is used in the repair and reinforcement of preexisting structures, a reactive mixture having a gelling period of 15 minutes or more at a temperature of 20° C. and which polymerizes even at 5° C. and is curable within 6 hours, and which has as chief components thereof a monomer containing vinyl groups and a reactive oligomer having vinyl groups and/or a thermoplastic polymer, is employed as the resin. Furthermore, the present invention provides an anisotropic textile for use in the repair and reinforcement of preexisting structures.

24 Claims, No Drawings

METHOD OF REPAIRING/REINFORCING EXISTING STRUCTURES AND ANISOTROPIC WOVEN FABRICS USED THEREFOR

TECHNICAL FIELD

The present invention relates to a repair and reinforcement method for preexisting structures such as bridge columns, piers, bridges, and buildings, and in particular, relates to a repair and reinforcement method for concrete structures, and to an anisotropic textile used in this method.

BACKGROUND ART

The repair and reinforcement of preexisting structures comprising concrete such as bridge columns, piers, bridges, and the like by the use of a unidirectional sheet material, in which carbon fibers, glass fibers, or high strength organic fibers are arranged in one direction, these are impregnated in advance with a small amount of resin, and are restricted in the weft direction and the thickness direction, or common textile materials, wherein these are affixed to the structures while impregnating with resin, and are then left to cure, is generally known.

In this case, cold-curing type epoxy resins, which have a long period of use and are comparatively easily handled, are most broadly employed as the matrix resin which is impregnated into the sheet material.

Furthermore, repair and reinforcement methods are also known in which, in order to shorten the work period at the site and to obtain stable properties, a so-called prepreg, which has been impregnated in advance with an appropriate amount of resin, is affixed, and this is then cured.

However, when the cold-curing epoxy resin which is commonly employed as a matrix resin in this field is used, although this is termed a cold-curing resin, the curing properties decline markedly below 10° C. and in particular below 5° C. and this leads to defects in curing and this leads to a lengthening of the execution period.

On the other hand, there has been much consideration given to the use of reinforcing materials (hereinbelow referred to as sheet materials) which form fiber-reinforced resin with resin. When a textile material comprising common reinforcement fibers is employed, the fibers run in two directions, so that the strength in one direction is less than half, and this is extremely disadvantageous when strengthening is particularly to be carried out in one direction, so that the use of a variety of unidirectional sheet materials has been considered.

(1) Use of Reinforcement Fiber Bundles

A technique in which reinforcement fiber bundles are wrapped around spots to be repaired and reinforced in preexisting structures while resin is being applied thereto is disclosed in Japanese Patent Application, First Publication No. Sho 62-33973 and Japanese Patent Application, First Publication No. Sho 62-244979.

(2) Use of a So-called Prepreg in which Resin is Impregnated in Advance into Reinforcement Fibers A technique in which a sheet material, in which a net-shaped material is applied to a prepreg, in which reinforcement fiber bundles are arranged and impregnated with resin so that the amount of resin contained is 15 weight percent or less, is applied to portions to be repaired or reinforced of preexisting structures, and curable resin is applied and impregnated from the surface thereof, is disclosed in Japanese Patent Application, First Publication No. Hei 7-228714.

(3) Use of Reinforcement Fiber Cloth in which Resin is Not Impregnated in Advance into the Reinforcement Fibers A technique in which a screen shaped sheet material in which carbon fibers are woven horizontally and vertically is applied to spots to be repaired and reinforced of preexisting structures, and a curable resin is applied and impregnated from the surface thereof, is disclosed in Japanese Patent Application, First Publication No. Sho 63-201269.

(4) Use of a Material which can be Positioned Between That of (2) and (3) A technique in which a sheet material, in which arranged reinforcement fiber bundles are applied to a supporting sheet via an adhesive layer, is applied to spots to be repaired and reinforced of preexisting structures, and a curable resin is applied and impregnated from the surface thereof, is disclosed in Japanese Patent Application, First Publication No. Hei 3-224901, Japanese Patent Application, First Publication No. Hei 4-149366, and Japanese Patent Application, First Publication No. Hei 5-32804.

However, in technique (1) above, in order to impregnate the reinforcement fiber bundles with resin and to wrap these around spots to be repaired and reinforced, it is necessary to use a dedicated-wrapping machine, and work is required to bring this machine to the site, and it is also difficult to use such a machine at sites for repair and reinforcement having a variety of conditions.

Furthermore, the sheet material which is employed in the technique described in (2) above is a sheet-shaped material in which, in order to ensure good handling properties during the carrying out of repairs, slightly more resin is applied to the reinforcement fibers than in the case of the level of a common sizing agent, the gaps between fibers are restricted, and a further net-shaped body is laid thereon, so that it is difficult to impregnate resin thereinto at the site in a short period of time, and it is not easy to use resin having a short period of use.

Furthermore, in the technique of (3) above, in the same way as in the case of a common textile material, a flat support body which is made unitary through the application of an amount of resin or an adhesive layer is not used; however, because of the severe restriction of the space between the reinforcement fibers themselves, the impregnation of resin is not easy, and resin having a short period of use cannot be employed.

Furthermore, in the technique described in (4) above, the arranged reinforcement fiber bundles are attached to a planar support body comprising a non-woven cloth or a net-shaped textile via adhesive layers, and this is made unitary, so that it is difficult to impregnate the resin in a short time at the site, and resin having a short period of use cannot be employed.

Furthermore, when sheet materials such as those described in (2) and (4) above are employed, when a resin having a low viscosity and great dissolving power such as an acrylic monomer or unsaturated polyester resins is impregnated, the resin which is to be impregnated is impregnated while dissolving the resin which was previously deposited in order to restrict the fibers, so that the fiber orientation becomes chaotic during the execution of the procedure, and it is impossible to obtain sufficient strength.

The present invention solves the problems described in the conventional art above; it has as an object thereof to provide a repair and reinforcement method for preexisting structures which is capable of execution even in poor conditions such as low temperature, and which is capable of exhibiting superior repair and reinforcement effects in a short period of time, as well as to provide an anisotropic textile which has superior handling properties and resin impregnation properties, and which also generates superior strength when hardened.

DISCLOSURE OF THE INVENTION

The present invention comprises a repair and reinforcement method for preexisting structures, wherein, during the repair and reinforcement of preexisting structures using a fiber-reinforced resin layer in which resin is impregnated into a sheet material comprising reinforced fibers and this resin is cured, the resin which is employed is a reactive mixture having a gelling time at 20° C. of 15 minutes or more and which initiates polymerization even at 5° C., and is curable in a period of time 6 hours less even at 5° C., and which has as the chief components thereof (1) a monomer having vinyl groups and (2) a reactive oligomer and/or a thermoplastic polymer having vinyl groups; and an anisotropic textile, having as the warp thereof a high strength and highly elastic fiber having a tensile strength of 3 GPa or more and a tensile elastic modulus of 150 GPa or more, and a fiber having a tensile elastic modulus lower than that of the warp as the weft thereof, wherein the weft comprises a compound thread having a weight of 0.1 g or less per one meter of fiber and comprising two types of fibers, the difference in the melting point of which is 50° C. or more, the gap in the weft in the direction of the warp is within a range of 3–15 mm, and the warp and weft are caused to adhere to one another by means of the fiber having a low melting point comprising the weft.

The anisotropic textile of the present invention has superior handling properties and resin impregnation properties, and generates superior strength when cured, and is thus useful in the repair and reinforcement of preexisting structures.

Furthermore the repair and reinforcement method for preexisting structures of the present invention which employs this anisotropic textile and specified resins even in a sheet-form material comprising reinforcement fibers may be carried out in poor conditions such as low temperatures, and is capable of exhibiting superior repair and reinforcement effects in a short period of time.

BEST MODE FOR CARRYING OUT THE INVENTION

First, the repair and reinforcement method for preexisting structures of the present invention will be explained.

In the repair and reinforcement method for preexisting structures in accordance with the present invention, during the repair and reinforcement of preexisting structures using a fiber-reinforced resin layer in which resin is impregnated into a sheet material comprising reinforcement fibers and cured, the resin which is employed is a reactive mixture (matrix resin) which has a gelling time at 20° C. of 15 minutes or more and which initiates polymerization even at 5° C., and is capable of sufficient curing in a comparatively short period of time (within 6 hours) even at 5° C., and which, moreover, has as the chief components thereof (1) a monomer having vinyl groups and (2) a reactive oligomer and/or a thermoplastic polymer having vinyl groups, and this is affixed to the preexisting structure while impregnating the sheet material comprising reinforcement fibers with this resin, and this is allowed to stand and cure.

Examples of high strength or highly elastic fibers which may be employed as the reinforcement fibers used in the sheet material comprising reinforcement fibers include, for example, inorganic fibers such as carbon fibers, glass fibers, and the like, or organic fibers such as aramid fibers or the like, which are commonly employed as reinforcement fibers. Furthermore, if these reinforcement fibers are mixed it presents no problem.

Among these, high strength and highly elastic fibers having a tensile strength of 3 GPa or more and a tensile elastic modulus of 105 GPa or more are particularly preferable for use as the warp of the anisotropic textile described above, and high strength carbon fibers having a tensile strength of 4 GPa or more are preferable. Examples of the sheet material comprising reinforcement fibers used in the present invention include, for example, woven cloth, unidirectionally oriented sheets, non-woven cloth, mats and the like comprising such reinforcement fibers, combinations of these, and such sheet materials comprising the reinforcement fibers into which the acrylic system resin described hereinbelow has been impregnated; anisotropic textiles are preferably employed.

In particular, in the present invention, a material (a) in which fibers are disposed so as to cross a sheet material in which reinforcement fibers are arranged in one direction is preferable for use as the sheet material comprising reinforcement fibers in which the reinforcement fibers are oriented in one direction and restricted in the horizontal direction; a material (b) in which heat-fusible fibers are disposed, with gaps within a range of 3–15 mm along the longitudinal direction of the reinforcement fibers, in a direction perpendicular to that of the reinforcement fibers in at least one surface of a sheet material in which reinforcement fibers are arranged in one direction, and these are heat-fused, is preferable for use as the sheet material comprising reinforcement fibers; and a material (c) in which a heat-fusible fiber cloth comprising thermoplastic resin, or comprising a web-shaped support body or net-shaped support body covered with thermoplastic resin, is heat-fused to at least one surface of a sheet material arranged in one direction, is preferable for use as the sheet material comprising reinforcement fibers.

Here, material (a) disclosed above is produced by disposing reinforcement fibers as the warp, and reinforcement fibers or other fibers, such as polyamide fibers, acrylic fibers, or fibers resulting from placing acrylic system resins or methacrylic system resins in a fiber shape, as the weft; in other words, from weaving or twining these.

Furthermore, material (b) is produced by arranging reinforcement fibers in a single direction as a sheet, disposing heat-fusible fibers along the width direction of the reinforcement fibers, and heat-fusing these. What is meant by the heat-fusible fibers employed here are fibers which melt and exhibit adhesive properties at temperatures above room temperature, or fibers which are coated on the surfaces thereof with substances which exhibit heat-fusing properties, or threads resulting from an intertwining of heat-fusible fibers and non-heat-fusible fibers, or a combination of any of these fibers. Examples thereof include fibers of polyethylene, polypropylene, polyamide, or acrylic or methacrylic system resins, as well as fibers resulting from a lightly heat-fusible finishing on such fibers, and fibers in which a substance which is heat-fusible such as polyamide or the like is deposited on the surface of fibers such as glass fibers or the like, or fibers resulting from an intertwining of fibers such as glass fibers and nylon threads; however, these fibers are not necessarily limited to these examples. What is meant by the arrangement of the fibers in this case may be the simple placement of the fibers in the surface, or the weaving or intertwining of strengthening fibers as the warp and heat-fusible fibers as the weft.

After the heat-fusible fibers are arranged, it is possible to obtain material (b) by heating these and causing a fusion with the reinforcement fibers.

Among these, the anisotropic textile described above employing a sheet material comprising reinforcement fibers is more preferably employed.

Additionally, material (c) above may be produced by heat-fusing a heat-fusible fiber cloth comprising a thermoplastic resin exhibiting melting and adhesive properties at temperatures above room temperature, or comprising a web-shaped support or net-shaped support body covered with thermoplastic resin, to at least one surface of a sheet-form material in which reinforcement fibers are arranged in one direction.

Examples of the heat-fusible fibers include fibers comprising polypropylene, polyamide, acrylic resin, methacrylic resin, or the like; and the net aperture of the net-shaped support body is preferably wider from the point of view of the impregnation of the resin, so that it is preferable that one polygonal side of the aperture portion be 1 mm or greater, and the surface area of the aperture should be 10 $mm^2$ or more. It is more preferable if one side has a length of 2.5 mm or more, while the aperture surface area is 15 $mm^2$ or more. On the other hand, from the point of view of preventing the loosening of the reinforcement fibers and the handling properties during cutting, it is preferable that the aperture be small, so that it is preferable that one side have a length of 20 mm or less and the aperture surface area be 500 $mm^2$ or less.

What is meant by a web-shaped support body is a sheet material resulting from an intertwining of short fibers or long fibers.

From the point of view of maintenance of interlayer shear strength and resin permeability among the mechanical properties of the substance obtained, it is preferable that the net- or web-shaped support body have a weight of 20 $g/m^2$ or less.

With respect to the materials employed in the fibers used for restricting the reinforcement fibers or the fusible fiber cloth or the like, the use of materials having good adhesive properties with the resin which is impregnated is preferable, so that after curing, superior strength and reinforcement effects can be generated.

When carbon fibers are employed as the reinforcement fibers, optimal carbon fibers for use in the sheet material should preferably be within a range of 100–800 $g/m^2$, and more preferably within a range of 150–600 $g/m^2$.

When the weight is less than 100 $g/m^2$, although the impregnation of the resin is satisfactory, the handling properties of the sheet material worsen, and in particular, the trend is towards the generation of slits in the carbon fibers bundles, and the number of layers affixed increases, so that the operation becomes complex. When this is in excess of 800 $g/m^2$, the impregnation of the resin worsens, and this is not desirable.

An explanation will now be given of the reason for the use of a reactive mixture as the resin in the present invention.

The resin which is employed in the present invention exhibits sufficient repair and reinforcement effects in a comparatively short period of time without requiring control of the conditions; it is important that this resin be capable of initiating polymerization even at 5° C., and that curing proceed to a level which exhibits sufficient strength in a comparatively short period of time. One benchmark for the time during which curing proceeds to a level exhibiting sufficient strength is a period of 24 hours; however, a period of 6 hours or less is preferable in order to effectively conduct the procedure, and a period of 3 hours or less is even more preferable. On the other hand, from the point of view of feasibility of the process of impregnating resin into the sheet material from the reinforcement fibers, it is necessary that the resin employed have a period of use at room temperature of 10 minutes or more, and preferably 15 minutes or more, and accordingly, a reactive mixture in which a curing reaction proceeds rapidly after the initiation of polymerization, and which is cured with a radical chain reaction, is preferable. The most preferable reactive mixture is a reactive mixture having as chief components thereof the components described hereinbelow, which has a period of use of 30 minutes or more at room temperature, and in which curing progresses to a level at which a sufficient strength is exhibited within a period of 3 hours.

Examples of component (1), a monomer having vinyl groups, include (meth)acrylate, (meth)acrylic acid, styrene, vinyl toluene, vinyl acetate, and the like. From the point of view of reactivity and the weather resistance of the resin after curing, the inclusion of (meth)acrylate as a chief component is preferable. What is indicated here by '(meth) acrylate' is acrylate and/or methacrylate.

Concrete examples thereof include: (meth)acrylate monomers having one functional group such as methyl (meth) acrylate, ethyl (meth)acrylate, propyl (meth)acrylate, n-butyl (meth)acrylate, t-butyl (meth)acrylate, isobutyl (meth)acrylate, 2-ethylhexyl (meth)acrylate, n-nonyl (meth) acrylate, cyclohexyl (meth)acrylate, benzyl (meth)acrylate, dicyclopentanyl (meth)acrylate, dicyclopentenyl (meth) acrylate, 2-dicyclopentenoxyethyl (meth)acrylate, isobornyl (meth)acrylate, methoxyethyl (meth)acrylate, ethoxyethyl (meth)acrylate, butoxyethyl (meth)acrylate, methoxyethoxyethyl (meth)acrylate, ethoxyethoxyethyl (meth) acrylate, tetrahydrofurfuryl (meth)acrylate, 2-hydroxyethyl (meth)acrylate, 2-hydroxypropyl (meth)acrylate, 4-hydroxybutyl (meth)acrylate, (meth)acrylic acid, (meth) acryloyl morpholine and the like; (meth)acrylate monomers with two functional groups such as ethylene glycol di(meth) acrylate, 1,2-propylene glycol di(meth)acrylate, 1,4-heptanediol di(meth)acrylate, 1,6-hexanediol (meth) acrylate, diethylene glycol di(meth)acrylate, neopentylglycol di(meth)acrylate, tetraethylene glycol di(meth)acrylate, 2-buten-1,4-di(meth)acrylate, cyclohexane-1,4-dimethanol (meth)acrylate, hydrogenated bisphenol A di(meth)acrylate, 1,5-pentane di(meth)acrylate, trimethylolethane di(meth)acrylate, tricyclodecane dimethanol di(meth)acrylate, trimethylolpropane di(meth)acrylate, dipropylene glycol di(meth)acrylate, 1,3-butylene glycol di(meth)acrylate, 2,2-bis-(4(meth)acryloxypropoxyphenyl) propane, 2,2-bis-(4-(meth)acryloxy(2-hydroxypropoxy) phenyl)propane, bis-(2-(meth)acryloyloxyethyl)phthalate, and the like; and (meth)acrylate monomers having three or more functional groups such as trimethylolpropane tri(meth) acrylate, trimethylolpropane ethylene glycol addition product of tri(meth)acrylate, ditrimethylolpropane tetra(meth) acrylate, trisacryloylethyl isocyanurate, and the like.

Among these, particularly preferable concrete examples are those which have good curing properties and low viscosity, including methyl (meth)acrylate, ethyl (meth) acrylate, propyl (meth)acrylate, n-butyl (meth)acrylate, t-butyl (meth)acrylate, isobutyl (meth)acrylate, 2-ethylhexyl (meth)acrylate, ethylene glycol di(meth)acrylate, diethylene glycol di(meth)acrylate, 1,3-butylene glycol di(meth) acrylate, and tetrahydrofurfuryl (meth)acrylate.

These monomers having vinyl groups may be used singly, or two or more may be used concomitantly.

Examples of component (2), the reactive oligomer having vinyl groups, include, in addition to the so-called macromonomers which result from the addition of a (meth) acrylic group to the end of a comparatively low molecular weight (meth)acrylate copolymer, styrene copolymer, or styrene-acrylonitrile copolymer; polyester (meth)acrylate, which is obtained by reacting a polybasic acid such as phthalic acid, adipic acid or the like with a polyhydric alcohol such as ethylene glycol, butanediol or the like, and (meth)acrylic acid; polyester (meth)acrylate containing allyl ether groups, which is obtained by the reaction of a polybasic acid such as phthalic acid, adipic acid or the like with a polyhydric alcohol such as ethylene glycol, butanediol or the like, and an alcohol containing allyl ether groups such as pentaerythritol triallyl ether, trimethylolpropane diallyl ether or the like, and (meth)acrylic acid; polyester containing allyl ether groups, which was obtained by reacting a polybasic acid such as phthalic acid, adipic acid or the like with a polyhydric alcohol such as ethylene glycol, butanediol or the like, and an alcohol containing allyl ether groups such as pentaerythritol triallyl ether, trimethylolpropane diallyl ether or the like; epoxy (meth)acrylate obtained by reacting an epoxy resin with (meth)acrylic acid; epoxy (meth)acrylate containing allyl ether groups, obtained by reacting a polybasic acid such as phthalic acid, adipic acid or the like with an epoxy resin and an alcohol containing allyl ether groups, such as pentaerythritol triallyl ether, trimethylolpropane diallyl ether and the like; urethane (meth)acrylate, which is obtained by reacting polyol, polyisocyanate and a monomer contain hydroxyl groups such as 2-hydroxyethyl (meth) acrylate or the like; urethane (meth)acrylate containing allyl ether groups, obtained by reacting polyol, polyisocyanate and an alcohol containing allyl ether groups such as pentaerythritol triallyl ether, trimethylolpropane diallyl ether or the like, and a monomer containing hydroxyl groups such 2-hydroxyethyl (meth)acrylate or the like; and urethane containing allyl ether groups, obtained by reacting polyol, polyisocyanate and an alcohol containing allyl ether groups such as pentaerythritol triallyl ether, trimethylolpropane diallyl ether or the like.

Preferable among these reactive oligomers are polyester (meth)acrylate containing allyl ether groups, obtained by reacting a polybasic acid, a polyhydric alcohol, an alcohol containing allyl ether groups and (meth)acrylic acid; epoxy (meth)acrylate, obtained by reacting an epoxy resin with (meth)acrylic acid, and epoxy (meth)acrylate containing allyl ether groups, obtained by reacting a polybasic acid, an epoxy resin, an alcohol containing allyl ether groups and (meth)acrylic acid; more preferable is such a reactive oligomer in solution in component (1), and particularly preferable is a reactive oligomer obtained using phthalic acid as the polybasic acid, bisphenol A and/or bisphenol F type epoxy resin having an epoxy equivalent of 970 or less as the epoxy resin, and pentaerythritol triallyl ether as the alcohol containing allyl ether groups. The epoxy equivalent weight of the epoxy resin employed is set to this level because at greater amounts the solubility in component (1) is reduced, and it thus becomes difficult to prepare a uniform resin and to apply and impregnate this resin uniformly into the sheet material comprising reinforcement fibers.

Further examples of component (2), the thermoplastic polymer, include, in addition to polymers or copolymers of (meth)acrylate monomers having one functional group, such as methyl (meth)acrylate, ethyl (meth)acrylate, propyl (meth)acrylate, n-butyl (meth)acrylate, t-butyl (meth) acrylate, isobutyl (meth)acrylate, 2-ethylhexyl(meth) acrylate, n-nonyl (meth)acrylate, cyclohexyl (meth)acrylate, benzyl (meth)acrylate, dicyclopentanyl (meth)acrylate, dicyclopentenyl (meth)acrylate, 2-dicyclopentenoxyethyl (meth)acrylate, isobornyl (meth)acrylate, methoxyethyl (meth)acrylate, ethoxyethyl (meth)acrylate, butoxyethyl (meth)acrylate, methoxyethoxyethyl (meth)acrylate, ethoxyethoxyethyl (meth)acrylate, tetrahydrofurfuryl (meth)acrylate, 2-hydroxyethyl (meth)acrylate, 2-hydroxypropyl (meth)acrylate, 4-hydroxybutyl (meth) acrylate, (meth)acrylic acid, and (meth)acryloyl morpholine and the like, copolymers of (meth)acrylate monomers and monomers which are copolymerizable with (meth)acrylate monomers such as styrene, polymers of monomers which are copolymerizable with (meth)acrylate monomers, cellulose system macromolecules such as cellulose acetate butyrate, cellulose acetate propionate, and the like, diallyl phthalate resin, epoxy resin, vinyl resins such as vinyl chloride and vinyl acetate resin and the like, and various thermoplastic elastomers; these thermoplastic polymers may be used singly or together. These are preferably employed in solution in component (1), as in the case of the reactive oligomers described above.

Furthermore, in order to improve various properties, it is possible to add a variety of additives, for example, plasticizers, weathering agents, anti-static agents, lubricants, release agents, paints, pigments, anti-foaming agents, polymerization inhibitors, and various types of fillers. In particular, in order to improve air blast effects, and provide gloss to the cured surface, and in order to increase dirt resistance, the addition of paraffins such as paraffin wax, microcrystalline wax, polyethylene wax, and the like, or addition of higher fatty acids such as stearic acid, 1,2-hydroxystearic acid, and the like, is preferable.

No particular restriction is made with respect to the curing catalyst which is used for the polymerization of such reactive mixtures, insofar as this comprises a curing catalyst system which meets the curing conditions, such as the period of use, the polymerization initiation temperature, and the curing period; catalyst systems which are commonly employed as curing catalysts for radical polymerization at room temperature may be used.

Concrete examples thereof include combinations of organic peroxides which are individually stable at room temperature (the temperature at the place of use) such as benzoyl peroxide, methylethylketone peroxide, and the like, and curing promoters which make possible the decomposition of such organic peroxides at room temperatures.

In order to avoid the dangers presented by the handling of benzoyl peroxide, it is preferable that this be used in the form of a paste or a powder in which the concentration is diluted to approximately 50% using an inert liquid or solid.

Examples of curing promoters include metallic soaps such as cobalt naphthenate, cobalt octylate, and the like, as well as aromatic tertiary amines such as dimethyl toluidine, diethyl toluidine, diisopropyl toluidine, dihydroxyethyl toluidine, dimethylaniline, diethyl aniline, diisopropyl aniline, dihydroxyethyl aniline and the like. The curing promoters may be used singly, or two or more may be used concomitantly, however the curing promoters are not limited to these examples.

It is preferable, from the point of view of the coating properties of the resin, the impregnation properties of the resin into a sheet material comprising reinforcement fibers, and the penetration into the concrete structure, that the viscosity of the reactive mixture be within a range of $5–10^4$ centipoise at 20° C., and more preferably within a range of 5–800 centipoise.

In the repair and reinforcement method of the present invention, the execution of foundation treatment on the surface of the preexisting structure on which execution is to be conducted, prior to carrying out the repair and reinforcement, is highly desirable in order to obtain sufficient repair and reinforcement effects. This foundation treatment may be conducted by means of a method in which initially, where coating or the like has been carried out on the surface of the structure, this is removed, and the surface is rendered smooth, whereupon cracked portions are filled in with a material having good adhesion properties with the reactive mixture which is employed in the present invention, and where necessary, this is subjected to further abrasion, and the surface is rendered smooth. Furthermore, the application of the reactive mixture employed in the present invention on to the surface on which repair and reinforcement is to be carried out, prior to carrying out the repair and reinforcement method of the present invention, is preferable in order to improve the adhesion properties.

Representative embodied configurations of the repair and reinforcement method of the present invention are given below.

(Embodied Configuration 1)

A reactive mixture in which an organic peroxide and a curing promoter are uniformly mixed is first applied to those portions on which repair and reinforcement is to be carried out, and after a sheet material comprising reinforcement fibers, and preferably an anisotropic textile, has been applied to the surfaces to which the reactive mixture was applied; the same reactive mixture is impregnated from the opposite side, and allowed to cure.

(Embodied Configuration 2)

A repair and reinforcement method for preexisting structures, in which a reactive mixture (liquid A) containing an organic peroxide but not containing a curing promoter is mixed with a reactive mixture (liquid B) containing a curing promoter but not containing an organic peroxide, using a two-liquid mixing-type coater provided with a cleaning pump, the mixed resin liquid is applied to those portions of the preexisting structure which are to be repaired and reinforced, a sheet material comprising strengthening fibers, and preferably an anisotropic textile, is applied to the surfaces to which the resin liquid was applied, liquid A and liquid B are again mixed using the two-liquid mixing-type coater, and the mixed resin liquid is applied to the outer surface of the sheet material comprising reinforcement fibers which was affixed and this resin is then allowed to cure.

(Embodied Configuration 3)

A reactive mixture (liquid A) containing an organic peroxide but not containing a curing promoter is first applied to those portions of the preexisting structure which are to be repaired and reinforced, and then a sheet material comprising reinforcement fibers, and preferably an anisotropic textile, is affixed thereto, whereupon a reactive mixture (liquid B) containing a curing promoter but not containing an organic peroxide is impregnated, and by means of the contact and mixture of liquid A and liquid B, curing is carried out.

Alternatively, liquid B may first be applied to those portions of the preexisting structure which are to be repaired and reinforced, a sheet material comprising reinforcement fibers, and preferably an anisotropic textile, is then affixed, whereupon liquid A is impregnated, and as a result of the contact and mixture of liquid A and liquid B, curing is carried out. The adoption of such a method is particularly desirable when a sufficient reactive mixture period of use is to be guaranteed. Liquid A and liquid B may of course be used in reverse order.

(Embodied Configuration 4)

A compound comprising the curing promoter of the reactive mixture may be deposited in advance on the sheet material comprising reinforcement fibers, and preferably on an anisotropic textile, and during execution, a reactive mixture which contains an organic peroxide but does not contain a curing promoter may be impregnated, initiating polymerization, and this may then be allowed to cure.

Alternatively, an organic peroxide may be applied in advance to the sheet material comprising reinforcement fibers, preferably an anisotropic textile, and during execution, this may be impregnated with a reactive mixture which contains a curing promoter but does not contain an organic peroxide, initiating polymerization, and thus carrying out curing.

(Embodied Configuration 5)

A reactive mixture (liquid A) which contains an organic peroxide but does not contain a curing promoter is first applied to those portions of the preexisting structure which are to be repaired and reinforced, and then a sheet material comprising reinforcement fibers, preferably an anisotropic textile, is affixed, and thereafter a reactive mixture (liquid B) which contains a curing promoter but does not contain an organic peroxide is impregnated, and on this, liquid A is again impregnated, and as a result of the contact and mixture of liquid A and liquid B, curing is carried out.

Alternatively, liquid B may first be applied to those portions of the preexisting structure which are to repaired and reinforced, a sheet material comprising reinforcement fibers, preferably an anisotropic textile, is affixed, and thereafter liquid A is impregnated, whereupon liquid B is impregnated, and as a result of the contact and mixture between liquid A and liquid B, curing is carried out. The adoption of this method is particularly desirable in cases in which a sufficient period of use is to be guaranteed for the reactive mixture, and in which a cured state which is more complete than a state in which there are few curing deficiency spots is desired.

In the repair and reinforcement method in accordance with the present invention, no particular restriction is made with respect to the method by which reactive mixtures are applied to the portions of the preexisting structures which are to be repaired and reinforced, or to the sheet material comprising reinforcement fibers; however, it is preferable that this be carried out in a short period of time by using a common spray gun, a two-liquid internal-mixing-type spray gun containing a static mixer, or a two-liquid external-mixing-type spray gun.

Next, the anisotropic textile will be explained; this is preferably employed as the sheet material comprising reinforcement fibers of the method for repair and reinforcement of preexisting structures described above, and is also preferably employed in conventional repair and reinforcement methods.

In order to effectively conduct the repair and reinforcement of preexisting structures, the use of a sheet material in which the high strength and highly elastic fibers employed are arranged in a single direction is important; however, a sheet material resulting solely from such arrangement cannot be handled, and is incapable of use as the material for repair and reinforcement. The so-called prepreg method, in which resin is impregnated in advance, is the most common method used to guarantee sufficient handling properties for use as a repair and reinforcement material; however, because the resin which cures at ordinary temperatures which is employed in such repair and reinforcement methods cures if it is not used immediately after impregnation, such resin is inappropriate for use as the matrix resin used in prepregs, and the common matrix resin for use in prepregs must be heated to a high temperature of over 100° C. in order to be cured, so that such resin is also inappropriate for use in the repair and reinforcement method for preexisting structures. For this reason, a method is commonly employed in which the amount of resin impregnated in advance is set to the lower limit necessary to guarantee the handling properties, and moreover, a curing agent is not contained so as to guarantee the period of use, and during execution, curing is conducted using a room-temperature-curing agent contained within a relatively large amount of resin which is additionally impregnated; however, the resin which is impregnated during execution is restricted to the same type of resin as that which was applied in advance, and it is necessary to apply a slightly greater amount than the standard amount of sizing agent in order to guarantee the handling properties during execution, so that the impregnation properties of the resin which is impregnated during execution decline dramatically. Furthermore, in order to improve the handling properties during execution, it is common to attach a planar support body such a non-woven cloth or a net type textile or the like via a resin applied to the reinforcement fibers, or an adhesive layer which is specially provided between a planar support body and the reinforcement fibers; however, although the handling properties improve, the impregnation properties of the resin during execution decline even more.

The anisotropic textile of the present invention does not involve the application of resin to the high strength and highly elastic fibers which are arranged in a single direction, so that there are no restrictions on the type of resin which may be impregnated during execution, and the impregnation properties are very good. In particular, resin which polymerizes and cures rapidly even at low temperatures may be employed as the matrix resin, so that there is no limitation of the environmental conditions during execution, and it is possible achieve a great shortening of the execution time. Furthermore, since this textile employs composite threads for the weft which have a lower tensile elastic modulus than that of the warp, and after weaving, the textile is heated to a temperature above the melting point of the low melting point fibers forming the composite threads and the weft and warp are appropriately adhered, the handling properties during execution are extremely good, and problems such as a disarrangement of the orientation of the fibers during execution, and a decrease in the reinforcement effect, do not occur.

In the present invention, it is possible to employ fibers which are commonly employed as reinforcement fibers as the fibers used in the warp, so that inorganic fibers such as carbon fibers or the like, and organic fibers such as aramide fibers or the like, may be employed; however, high strength and highly elastic fibers having a tensile strength of 3 GPa or more and a tensile elastic modulus of 150 GPa or more are preferable. High strength carbon fibers having a tensile strength of 4 GPa or more are particularly preferable as they provide superior reinforcement effects.

In the present invention, a composite thread comprising two types of fibers having a melting point difference of 50 ° C. or more is used as the weft. The fiber with the high melting point in the composite thread is the basic weft; this functions as the weft at least until the end of execution. Accordingly, a certain amount of strength and elastic modulus is required; however, the tensile elastic modulus must be less than that of the warp. When the tensile elastic modulus is greater than that of the warp, the warp tends to drift in the longitudinal direction, and sufficient tensile strength is not attained. The preferred tensile elastic modulus range of the weft is 50–100 GPa. Furthermore, in order to prevent a disordering of the orientation of the fibers during execution, it is very important that this does not dissolve in the resin which forms the matrix resin. Examples of such high melting point fibers include glass fibers; however, these fibers are not necessarily limited to this example.

The low melting point fibers are fibers which are necessary in order to cause the warp and weft to become unitary after weaving and in order to provide superior handling properties. Without these low melting point fibers, a disordering of the fibers during handling is likely to occur, and sufficient reinforcement effects cannot be obtained. Examples of these low melting point fibers include low melting point polyamide fibers, polyester fibers, and polyolefin fibers; however, these fibers are not necessarily restricted to these examples.

The two types of fibers described above are necessary components of the composite threads which are employed in the weft; however, in order to improve the handling properties during execution by unifying these two types of fibers and strengthening the adhesion between the warp and weft prior to the impregnation of resin, it is preferable to use composite threads to which have been applied 0.5–10 weight percent of a high molecular compound which melts or softens at a temperature of 100° C. or less. The high molecular compound which is deposited is not particularly restricted insofar as it is a compound which melts or softens at a temperature of 150° C. or less; however, compounds which are water-soluble or are capable of forming an aqueous emulsion are preferable, since they facilitate the process of deposition onto the composite threads. Examples of such high molecular compounds include polyvinyl acetate, ethylene-vinyl acetate copolymer, vinyl acetate-acrylic copolymer, polyacrylic ester, polyester, polyethylene, and polybutadiene system copolymers; however, these compounds are not necessarily limited to the examples given.

The low melting point fibers used in the weft of the present invention and the high molecular compound which melts or softens at temperatures of 150 ° C. or less contribute to the superior handling properties of the anisotropic textiles; however, from the point of view of the mechanical properties after curing, particularly the generation of tensile strength, it is desirable that the restriction of the warp by the weft be weak. Accordingly, it is desirable to choose low melting point fibers and a high molecular compound which gradually change to a non-adhesive state as a result of the reactive mixture impregnated during execution, and to control the amount of high molecular compound deposited. In particular, it is preferable that the high molecular compound be somewhat soluble in the reactive mixture which is impregnated during execution, and it is desirable that this compound be selected in concert with the reactive mixture which is impregnated.

Furthermore, from the point of view of providing strength after curing, it is desirable that the weft be as thin as possible, so that the weight per meter of the fiber is preferably 0.1 g or less, and more preferably within a range of 0.01–0.05 g.

The preferable ratio of the high melting point fibers and the low melting point fibers in the composite threads is such that, in volumetric ratio, with respect to one unit of high melting point fibers, the low melting point fibers should be within a range of 0.25–2.0, and a range of 0.5–1.5 is more preferable from the point of view of the adhesive properties and the mechanical properties.

The weft spacing in the anisotropic textile of the present invention is within a range of 3–15 mm. When the spacing is less than 3 mm, the drift of the warp in the longitudinal direction cannot be ignored, and sufficient tensile strength will not be attained after curing of impregnation resin, while when the spacing is greater than 15 mm, the handling properties of the sheet material worsen, and this is not desirable. A more preferable weft spacing range is 4–10 mm.

Any resin may be employed as the resin which is used in combination with the anisotropic textile insofar as it obtains sufficient repair and reinforcement effects, is easily impregnated into the anisotropic textile at room temperatures, and exhibits sufficient strength after curing; however, in order to produce sufficient repair and reinforcement effects in a comparatively short period of time without controlling the environmental conditions, it is necessary to employ a resin which initiates polymerization even at 5° C., and in which curing proceeds to a level which exhibits sufficient strength in a comparatively short period of time. It is possible to use 24 hours as a period during which curing proceeds to a level which is exhibits sufficient strength; however, a period of 6 hours or less is preferable in order to efficiently conduct operations, and a period of 3 hours or less is even more preferable. On the other hand, from the point of view of facilitating the operation in which the resin is impregnated into the anisotropic textile, it is necessary that the resin which is employed have a period of use which is 10 minutes or greater, and preferably 15 minutes or greater, at room temperatures, and accordingly, the reactive mixtures described above, in which the curing reaction proceeds rapidly after the initiation of polymerization, and curing is conducted with a radical chain reaction are preferable. The most preferable reactive mixture is one which has a period of use of 30 minutes or more at room temperature and in which curing proceeds to a level which exhibits sufficient strength within a period of 3 hours.

EMBODIMENTS

Hereinbelow, the present invention will be discussed in greater detail using embodiments. In these embodiments, 'parts' refers to 'parts per weight'.

Embodiment 1

Glass fibers (having a tensile elastic modulus of 72.5 GPa, a melting point of 840° C., and a specific gravity of 2.54 g/cm$^3$) having a TEX number of 22.5 (0.0225 g/m) were twisted together with low melting point polyamide multifilaments (having a melting point of 125° C. and a specific gravity of 1.08 g/cm$^3$) having a total denier of 70 deniers, and an ethylene vinyl acetate copolymer (having a melting point of 80° C.) was deposited thereon in an amount of 1.5 g per 1000 m of the twisted thread; and a composite thread, which served as the weft, was obtained. The weight per meter of this composite thread was approximately 0.03 g, and the ratio of the high melting point fibers and the low melting point fibers was 1:0.8 in volumetric ratio.

Pyrofil TR30G carbon fibers (having a tensile strength of 4.5 GPa, a tensile elastic modulus of 235 GPa, and a filament count of 12000) produced by Mitsubishi Rayon Co. Ltd. were arranged so as to reach 300 g/m$^2$, and this was used as the warp, while the composite thread described above was used as the weft, weaving was accomplished so that the weft spacing was 5 mm, and an anisotropic textile was obtained. Furthermore, by passing this textile through a pair of rollers heated to 180° C., the anisotropic textile of the present invention, in which the warp and weft partially adhered to one another, was obtained. The anisotropic textile which was obtained was flexible and extremely easy to handle, since somewhat rough handling thereof did not cause disordering of the fibers or breakdown of the weave.

70 parts of methyl methacrylate, two parts of 1,3-butylene glycol dimethacrylate, 25 parts of butyl acrylate macromonomer having a number-average molecular weight of 6,000 and having a methacrylic group on the terminus thereof, one part of n-paraffin, and 1 part of γ-methacryloxypropyl trimethoxysilane were sufficiently mixed so as to be uniform, and then finally one part of N,N-dimethyl-p-toluidine was added and mixed, and this produced the reactive mixture containing no organic peroxide.

The viscosity at 20° C. thereof was measured and found to be 75 centipoise.

A reactive mixture resulting from the addition of two parts of benzoyl peroxide diluted to 50% with a plasticizer to 100 parts of the reactive mixture described above was impregnated into two plies of the above anisotropic textiles so that the resin weight reached approximately 1000 g/n$^2$, and this was allowed to stand for one hour at a standard temperature (20° C.), and cured. A tension test piece was produced from the composite obtained, and was evaluated. When converted to a fiber content ratio of 100% (dividing by the theoretical thickness of the anisotropic textile), the tensile strength was 390 kgf/mm$^2$ (3.82 GPa), and it was thus confirmed that sufficient strength was present. Furthermore, the impregnation properties of the resin were extremely good.

Embodiment 2

Two parts of benzoyl peroxide diluted to 50% in a plasticizer were added to 100 parts of the reactive mixture of embodiment 1, and this was applied in an amount of 250 g/m$^2$ to the surface of a concrete bending test piece in conformity with JIS A1132 to which the anisotropic textile was to be affixed (the side subject to tensile deformation), and an anisotropic textile identical to that of embodiment 1 was affixed thereto so that the orientation direction of the reinforcement fibers was aligned with the longitudinal direction of the concrete test piece, and thereafter, the reactive mixture was applied thereon to amount of 250 g/m$^2$, this was impregnated into the anisotropic textile, and was allowed to stand. The gelling time at the standard temperature (20° C.) of the reactive mixture was approximately 25 minutes; however, since the anisotropic textile was easy to handle and the impregnation of the reactive mixture was also extremely good, the operation proceeded smoothly, and it was a simple matter to conduct the operation of affixing the textile to six test spots in the space of a few minutes. The curing was completed in a period of approximately 1 hour from the admixture of an organic peroxide (the benzoyl peroxide diluted to 50% in a plasticizer), and the bonding to the concrete after a period of one hour and a half was evaluated using a bonding test by the Building Research Institute method in accordance with JIS A6909. Breakage occurred at the concrete portions, so that it was determined that sufficient adhesive strength was obtained. Next, a bending test in accordance with JIS A1106 was executed, and the reinforcement effects were confirmed. The results of a bending test without reinforcement were 90 kgf/cm$^2$ (8.8 MPa), while the results when reinforcement was conducted were 160 kgf/cm$^2$ (15.7 MPa).

Embodiment 3

Test pieces were produced and evaluated in the same manner as in embodiment 2, with the exception that the operation in which the textile was affixed to the concrete test piece was conducted at 5° C. Even at 5° C., curing was sufficient after 2 hours, and in the bonding test, breakage occurred at the concrete portion. Furthermore, the bending strength increased, at 155 kgf/cm$^2$ (15.2 MPa), and sufficient reinforcement effects were thus confirmed even as a result of execution at low temperatures.

Embodiments 4–16, Comparative Examples 1–6

Composite test pieces were produced and evaluated using anisotropic textiles identical to those of embodiment 1, with the exception that the composition of the composite thread used as the weft, and the spacing of the weft in the anisotropic textile, differed. The composition of the anisotropic textiles and the results of the evaluations are shown in tables 1,2,3 and 4. The abbreviations and references in the tables are as given below.

CF: Pyrofil TR30G carbon fibers produced by Mitsubishi Rayon Co. Ltd.

The numbers in the tables refer to the CF areal weight of the anisotropic textile.

GF: glass fibers (having a tensile elastic modulus of 72.5 GPa, a melting point of 840° C. and a specific gravity of 2.54 g/cm$^3$)

PA: low melting point polyamide multifilaments (having a melting point of 125° C. and a specific gravity of 1.08 g/cm$^3$)

PE: low melting point polyester multifilaments (having a melting point of 130° C. and a specific gravity of g/cm$^3$)

PO: low melting point polyolefin multifilaments (having a melting point of 100° C. and a specific gravity of g/cm$^3$)

The number shown under headings GF-PO in the tables indicate the weights per unit length of each fiber used in the weft of the anisotropic textile.

EV: ethylene vinyl acetate copolymer (having a melting point of 80° C.)

AC: acrylic system copolymer (having a melting point of 75° C.)

The numerals in the table refer to the weight percent of high molecular compound in the composite thread.

Handling properties, impregnation properties of the resin: Double circle . . . extremely good, Circle . . . good, Triangle . . . somewhat poor, and X . . . poor Tensile strength: shown in units of kgf/mm$^2$

TABLE 1

| | Embodiment 4 | Embodiment 5 | Embodiment 6 | Comparative Example 1 | Embodiment 7 | Embodiment 8 |
|---|---|---|---|---|---|---|
| Anisotropic Textile Composition | | | | | | |
| warp CF g/m$^2$ | 300 | 300 | 300 | 300 | 300 | 300 |
| weft | | | | | | |
| (A) GF g/m | 0.0112 | 0.0375 | 0.0675 | 0.135 | 0.0225 | 0.0225 |
| PA g/m | 0.0078 | 0.0078 | 0.0078 | 0.0078 | 0.0033 | 0.0056 |
| (B) PE g/m | — | — | — | — | — | — |
| PO g/m | — | — | — | — | — | — |
| (A):(B) | 1:1.6 | 1:0.54 | 1:0.27 | 1:0.14 | 1:0.34 | 1:0.59 |
| High Molecular Compound | | | | | | |
| EV wt % | 5 | 5 | 5 | 5 | 5 | 5 |
| AC wt % | — | — | — | — | — | — |
| Spacing mm | 5 | 5 | 5 | 5 | 5 | 5 |
| Characteristics | | | | | | |
| handling properties | ◎ | ◎ | ○ | Δ | ◎ | ◎ |
| Resin Impregnation Properties | ◎ | ◎ | ◎ | ◎ | ○ | ◎ |
| Tensile Strength | 400 | 385 | 370 | 325 | 375 | 395 |

TABLE 2

| | Embodiment 9 | Comparative Example 2 | Embodiment 10 | Embodiment 11 | Comparative Example 3 |
|---|---|---|---|---|---|
| Anisotropic Textile Composition | | | | | |
| warp CF g/m$^2$ | 300 | 300 | 300 | 300 | 300 |
| weft | | | | | |
| (A) GF g/m | 0.0225 | 0.0225 | 0.0225 | 0.0225 | 0.0225 |
| PA g/m | 0.0111 | 0.0333 | 0.0078 | 0.0078 | 0.0078 |
| (B) PE g/m | — | — | — | — | — |
| PO g/m | — | — | — | — | — |
| (A):(B) | 1:1.16 | 1:3.48 | 1:0.81 | 1:0.81 | 1:0.81 |

TABLE 2-continued

| | Embodiment 9 | Comparative Example 2 | Embodiment 10 | Embodiment 11 | Comparative Example 3 |
|---|---|---|---|---|---|
| High Molecular Compound | | | | | |
| EV wt % | 5 | 5 | 1 | 7 | 15 |
| AC wt % | — | — | — | — | — |
| Spacing mm | 5 | 5 | 5 | 5 | 5 |
| Characteristics | | | | | |
| handling properties | ◎ | ◎ | ○ | ◎ | ◎ |
| Resin Impregnation Properties | ◎ | Δ | ◎ | ◎ | x |
| Tensile Strength | 385 | 350 | 395 | 390 | 345 |

TABLE 3

| | Comparative Example 4 | Embodiment 12 | Embodiment 13 | Comparative Example 5 |
|---|---|---|---|---|
| Anisotropic Textile Composition | | | | |
| warp CF g/m$^2$ | 300 | 300 | 300 | 300 |
| weft | | | | |
| (A) GF g/m | 0.0225 | 0.0225 | 0.0225 | 0.0225 |
| PA g/m | 0.0078 | 0.0078 | 0.0078 | 0.0078 |
| (B) PE g/m | — | — | — | — |
| PO g/m | — | — | — | — |
| (A):(B) | 1:0.81 | 1:0.81 | 1:0.81 | 1:0.81 |
| High Molecular Compound | | | | |
| EV wt % | 5 | 5 | 5 | 5 |
| AC wt % | — | — | — | — |
| Spacing mm | 1 | 3 | 10 | 20 |
| Characteristics | | | | |
| handling properties | ◎ | ◎ | ◎ | x |
| Resin Impregnation Properties | x | ○ | ◎ | ◎ |
| Tensile Strength | 310 | 380 | 385 | 385 |

TABLE 4

| | Embodiment 14 | Embodiment 15 | Embodiment 16 | Comparative Example 6 |
|---|---|---|---|---|
| Anisotropic Textile Composition | | | | |
| warp CF g/m$^2$ | 300 | 300 | 300 | 300 |
| weft | | | | |
| (A) GF g/m | 0.0225 | 0.0225 | 0.0675 | 0.1012 |
| PA g/m | — | — | 0.0222 | 0.0333 |
| (B) PE g/m | 0.0078 | — | — | — |
| PO g/m | — | 0.0078 | — | — |
| (A):(B) | 1:0.81 | 1:0.81 | 1:0.77 | 1:0.77 |
| High Molecular Compound | | | | |
| EV wt % | — | — | 5 | 5 |
| AC wt % | 5 | 5 | — | 5 |
| Spacing mm | 5 | 5 | 5 | 5 |
| Characteristics | | | | |
| handling properties | ◎ | ◎ | ◎ | ◎ |
| Resin Impregnation Properties | ◎ | ◎ | ○ | ◎ |
| Tensile Strength | 390 | 395 | 370 | 336 |

Embodiment 17

70 parts of methyl methacrylate, two parts of 1,3-butylene glycol dimethacrylate, 25 parts n-butyl acrylate macromonomer having a number average molecular weight of 6,000 and having a methacrylic group on the terminal thereof, one part of n-paraffin, and one part of γ-methacryloxypropyl trimethoxysilane were sufficiently mixed so as to be uniform, and then two parts of N,N-dimethyl-p-toluidine were added, and the reactive mixture A containing no organic peroxides was obtained.

The viscosity at 20° C. was measured and found to be 75 centipoise.

Furthermore, a reactive mixture B containing organic peroxides and containing no curing promoter was obtained by adding four parts of benzoyl peroxide diluted to 50% with a plasticizer in place of the two parts of N,N-dimethyl-p-toluidine described above.

The viscosity thereof was measured at 20° C. and found to be 75 centipoise.

The reactive mixture A described above was applied to the surface of a concrete bending test piece to which the anisotropic textile was to be affixed so as to reach a level of 250 g/m$^2$, and after an anisotropic textile identical to that of embodiment 1 was affixed thereto, reactive mixture B. was applied thereon in an amount of 250 g/m$^2$, and this impregnated into the anisotropic textile and was allowed to stand. Reactive mixture A and reactive mixture B were both stable at standard temperatures in isolation; however, after mixing, a reaction rapidly proceeded, and gelling occurred after approximately 30 minutes. Since both reactive mixtures A and B impregnated into the anisotropic textile extremely well, the operation preceded smoothly, and it was possible to complete the affixing of the textile to six test pieces in a few minutes. The curing was completed in approximately one hour after the impregnation of reactive mixture B, and when a Building Research Institute type test of the bonding to the concrete was conducted after a period of one and a half hours, the breakage occurred at the concrete portions, so that it was confirmed that sufficient bonding strength was obtained. Next, a bending test was conducted, and the reinforcement effects were confirmed. The bending strength when reinforcement was not carried out was 90 kgf/cm$^2$ (8.8 MPa), whereas the bending strength when reinforcement was carried out was 150 kgf/cm$^2$ (14.7 MPa).

Embodiment 18

10 parts of N,N-dimethyl-p-toluidine and 20 parts of n-butyl acrylate macromonomer having a number average molecular weight of 6,000 were dissolved in 70 parts methylethylketone, and this was uniformly mixed. By means of treating an anisotropic textile identical to that of embodiment 1 with this mixture, an anisotropic textile was prepared on which was deposited, per square meter, 5 g of N,N-dimethyl-p-toluidine and 10 g of n-butyl acrylate macromonomer having a number average molecular weight of 6,000.

70 parts per weight of methyl methacrylate, 2 parts per weight of 1,3-butylene glycol dimethacrylate, 23 parts of n-butyl acrylate macromonomer having a number average molecular weight of 6,000 and having a methacrylate group on the terminal thereof, one part of n-paraffin, and one part of γ-methacryloxypropyl trimethoxysilane were mixed sufficiently so as to become uniform, and then two parts of benzoyl peroxide diluted to 50% in a plasticizer were added, and thus a reactive mixture containing an organic peroxide but not containing a curing promoter was prepared.

The viscosity thereof was measured at 20° C. and was found to be 70 centipoise.

The reactive mixture not containing a curing promoter described above was applied to the surface of a concrete bending test piece to which the anisotropic textile was to be affixed, in an amount of 250 g/m$^2$, and then the anisotropic textile described above, on which N,N-dimethyl-p-toluidine was deposited, was affixed, and then the reactive mixture described above was again applied thereon in an amount of 250 g/m$^2$, and this was allowed to impregnate into the anisotropic textile and was allowed to stand.

The anisotropic textile described above was extremely easy to handle and the impregnation of the reactive mixture was also extremely good, so that the operation proceeded smoothly, and it was possible to affix the textile to 6 test pieces in the space of a few minutes. The curing was conducted in approximately 1 hour from the impregnation of the reactive mixture described above, and when Building Research Institute type test of the bonding to the concrete was conducted after a period of one and half hours, the breakage occurred at the concrete portions, so that it was determined that sufficient bonding strength was obtained. Next, a bending test was carried out, and the reinforcement effects were confirmed. As a result of the reinforcement, the bending strength increased to 165 kgf/cm$^2$ (16.2 Mpa).

Embodiment 19

Concrete bending test pieces were produced and evaluated which were reinforced with anisotropic textiles identical to those of embodiment 2, with the exception that, in place of the n-butyl acrylate macromonomer, a polyester methacrylate containing allyl ether groups, which was produced by reacting phthalic acid, ethylene glycol, pentaerythritol triallylether, and methacrylic acid, was employed, and one part cobalt naphthenate was used as a curing promoter. The viscosity of this reactive mixture at 20° C. was found to be 250 centipoise. The gelling time at the standard temperature (20° C.) was approximately 30 minutes, and no problems were presented by the affixing operation of the anisotropic textile. Furthermore, the bending strength of the test pieces reinforced with this anisotropic textile was 160 kgf/cm$^2$ (15.7 MPa), and it was thus confirmed that sufficient reinforcement effects were obtained.

Embodiment 20

Concrete bending test pieces were produced and evaluated which were reinforced with anisotropic textiles identical to those of embodiment 19, with the exception that, in place of the polyester methacrylate containing allyl ether groups, an epoxy methacrylate which was obtained by reacting an epoxy resin containing 190 g/eq. of epoxy with methacrylic acid, was employed.

The viscosity of this reactive mixture at 20° C. was found to be 350 centipoise, and the gelling time at the standard temperature (20° C.) was approximately 30 minutes, so that the affixing operation of the anisotropic textile presented no difficulties. Furthermore, the bending strength of the test pieces reinforced with this anisotropic textile was 155 kgf/cm$^2$ (15.2 MPa), and it was thus confirmed that sufficient reinforcement effects were obtained.

Embodiment 21

Concrete bending test pieces were produced and evaluated which were reinforced with anisotropic textiles identical to those of embodiment 19, with the exception that, in place of the polyester methacrylate containing allyl ether groups, an epoxy acrylate containing allyl ether groups, which was obtained by reacting phthalic acid, a bisphenol A type epoxy resin containing 875 epoxy equivalents (Epikote 1004, produced by Yuka Shell Epoxy Corporation), pentaerythritol triallyl ether, and acrylic acid, was employed.

The viscosity of this reactive mixture at 20° C. was found to be 350 centipoise, and the gelling time thereof at the standard temperature (20° C.) was approximately 15 minutes, and no problems were presented by the affixing operation of the anisotropic textile. Furthermore, the bending strength of the test pieces reinforced with this anisotropic textile was 162 kgf/cm$^2$ (15.9 MPa), and it was thus confirmed that sufficient reinforcement effects were obtained.

Embodiment 22

Pyrofil TR- 30G carbon fibers (with a filament count of 12,000) produced by Mitsubishi Rayon Co. Ltd. were arranged in a single direction using a batten and a comb, with a width of 300 mm and at a spacing of 2.5 mm, and threads, in which glass fibers having TEX number 22.5 (the ECG225 1/0 standard) and low melting point nylon fibers (having a melting point of 125° C.) of 70 deniers were intertwined, were arranged so as to be perpendicular to the carbon fibers in both surfaces with a spacing in each surface of 25 mm, arranged in an alternating manner in both surfaces so that the sheet as a whole had a spacing of 12.5 mm, and this was then heat melted using a heat press at a temperature of 180° C., and thereby, a sheet material 1 comprising reinforcement fibers was obtained.

The preparation of the resin was as follows: first, as component (1), 60 parts methyl methacrylate/10 parts 2-ethylhexyl acrylate/2 parts 1,3-butylene glycol dimethacrylate, 1 part of n-paraffin (having a melting point within a range of 54–56° C.) as a paraffin wax, and one part of γ-methacryloxypropyl trimethoxysilane as a silane coupling agent, were mixed and heated to a temperature of 50° C., and then 25 parts of an acrylic copolymer having an average molecular weight of 42000 and comprising methyl methacrylate and n-butyl methacrylate in a 60/40 ratio (by weight) was added as component (2), and thereafter, while cooling, one part of N,N-dimethyl-p-toluidine was added, and a resin liquid was obtained. The viscosity at 20° C. was measured at 80 centipoise.

Two parts of benzoyl peroxide diluted to 50% using a plasticizer was added to 100 parts of the above resin liquid, this was mixed, and the reactive mixture was obtained (this is termed resin liquid 1).

A base layer of resin liquid 1 was applied to a high strength quick curing concrete wall, and the sheet material 1 comprising reinforcement fibers was affixed on top of this, and resin liquid 1 was again applied on top of this, and this was impregnated using a pile roller.

Resin liquid 1 impregnated well into sheet material 1. Furthermore, resin liquid 1 was completely cured after a period of 30 minutes-at the standard temperature (20° C.), and was completely cured after a period of 1 hour even at a low temperature (5° C.) and exhibited sufficient elasticity and strength. The bonding to the concrete was good, and when Building Research Institute type bonding test was conducted after a period of 1 hour of resin curing at the standard temperature, the strength was found to be 50 kg/cm$^2$ (4.9 MPa), and even under low temperature curing conditions, the strength after 1 hour of curing was found to be 48 kg/cm$^2$ (4.7 MPa), and breakage occurred within the concrete.

Bending tests and compression tests were conducted using concrete sample pieces to which sheet material 1 was affixed at the standard temperature, and the reinforcement effects were confirmed. The bending strength was 87 kg/cm$^2$ (8.5 MPa) when reinforcement was not conducted, while when reinforcement was conducted, this strength rose to 166 kg/cm$^2$ (16.3 MPa). The compression strength was tested in accordance with JIS A1108, using a concrete test piece having a diameter of 10 cm and a height of 20 cm, on which one layer of sheet material 1 was affixed so at the standard temperature so that the direction of orientation of the reinforcement fibers was the axial direction, and on top of this, another layer was affixed so that the direction thereof was the circumferencial direction, and the overlap length was 10 cm. The strength when reinforcement was not conducted was 274 kg/cm$^2$ (26.9 MPa), whereas when reinforcement was conducted, the strength rose to 552 kg/cm$^2$ (54.1 Mpa). The proportion of resin contained in the repair and reinforcement layer was 62 weight percent.

Embodiment 23

Pyrofil TR- 30 G carbon fibers (with a filament count of 12000) produced by Mitsubishi Rayon Co. Ltd. were used for the warp at 10 per inch, while glass fibers (the ECG 450-1/0 standard) were used for the weft at 6 per inch, and these were woven together to produce a screen shaped carbon fiber woven cloth 2.

The execution properties and reinforcement effects were assessed in the same manner as in embodiment 22, with the exception that this woven cloth 2 was used in place of the sheet material 1.

The resin liquid 1 impregnated well into the woven cloth 2. Furthermore, the resin liquid 1 cured completely in a period of 30 minutes at the standard temperature (20° C.), and even at low temperature (5° C.), was completely cured after a period of 1 hour and exhibited sufficient elasticity and strength.

The bonding to the concrete was good, and when a bonding test by the Building Research Institute method was carried out after one hour of resin curing at the standard temperature, the strength was found to be 48 kg/cm$^2$ (4.7 MPa), and the breakage was within the concrete.

The results of a bending test and a compression test were that the bending strength was 160 kg/cm$^2$ (15.7 MPa), while the compressive strength was 550 kg/cm$^2$ (53.9 MPa). The proportion of resin contained in the repair and reinforcement layer was 65 weight percent.

Embodiment 24

Pyrofil TR- 30G carbon fibers (with a filament count of 12000) produced by Mitsubishi Rayon Co. Ltd. were used for the warp at 10 per inch, and threads in which glass fibers (the ECG 450-1/0 standard) and low melting point nylon (polyamide) fibers (having a melting point of 125° C.) were intertwined, were used as the weft at 6 per inch, and these were woven, and subsequently a temperature of 180° C. was applied thereto, to produce a screen shaped carbon fiber woven cloth 3 (anisotropic textile).

The execution properties and reinforcement effects were assessed in the same manner as in embodiment 22, with the exception that this woven cloth 3 was used in place of the sheet material 1.

The resin liquid 1 impregnated easily into the woven cloth 3. Furthermore, the resin liquid 1 cured completely in a period of 30 minutes, and even at low temperature (5° C.), the resin cured completely after a period of 1 hour, and exhibited sufficient elasticity and strength.

The bonding to the concrete was good, and when a bonding test by Building Research Institute method was carried out after a period of one hour of resin curing at the standard temperature, the strength was found to be 48 kg/cm$^2$ (4.7 MPa), and even under low temperature curing conditions, a strength of 48 kg/cm$^2$ (4.7 MPa) was obtained after a curing period of one hour, and the breakage was within the concrete.

The results of a bending test and a compression test were that the bending strength was 160 kg/cm$^2$ (15.7 MPa), while the compressive strength was 552 kg/cm$^2$ (54.1 MPa). The proportion of resin contained in the repair and reinforcement layer was 60 weight percent.

Embodiment 25

Pyrofil TR- 30G carbon fibers (with a filament count of 12000) produced by Mitsubishi Rayon Co. Ltd. were arranged using a batten and a comb in a single direction with a width of 300 mm and at a spacing of 2.5 mm, and on both surfaces of this, Nisseki Konwed Net ON5050 (having a weight of 7 g/m$^2$ and an 8 mm×8 mm knot) produced by Nisseki Sheet Pallet System Corporation were disposed as heat-fusible nets, and this was passed through heated rollers at a temperature of 100° C. and at a pressure of 1 kg/cm$^2$ (0.1 MPa) for a period of 40 seconds, and by thus melting the meltable net surfaces and attaching them to the carbon fibers, a sheet material 4 comprising reinforcement fibers was obtained.

The execution properties and reinforcement effects were assessed in the same manner as in embodiment 22, with the exception that this sheet material 1 was used in place of the sheet material 4.

The resin liquid 1 impregnated easily into the woven cloth 4. Furthermore, the resin liquid 1 cured completely after a period of 30 minutes, and even at low temperature (5° C.), the curing was completed after a period of 1 hour, and sufficient elasticity and strength were exhibited.

The bonding to the concrete was good, and when a bonding test by the Building Research Institute method was conducted after a period of one hour of resin curing at the standard temperature, the strength was found to be 49 kg/cm$^2$ (4.8 MPa), and the breakage was within the concrete.

The results of a bending test and a compression test were that the bending strength was 161 kg/cm$^2$ (15.8 MPa), while the compressive strength was 548 kg/cm$^2$ (53.7 MPa).

Embodiment 26

Pyrofil TR- 30G carbon fibers (with a filament count of 12000) produced by Mitsubishi Rayon Co. Ltd. were arranged in a single direction using a batten and a comb at a width of 300 mm and at a spacing of 2.5 mm, and on both surfaces thereof, the Daiamid span (having a weight of 13 g/m$^2$) produced by Daicell-Huils Ltd. was disposed as meltable non-woven fabric, and this was passed through heated rollers at a temperature of 130° C. and at a pressure of 1 kg/cm$^2$ for a period of 40 seconds, and by means of thus melting the heat-fusible non-woven fabric and attaching them to the carbon fibers, a sheet material 5 comprising reinforcement fibers was obtained.

The execution properties and reinforcement effects were assessed in the same manner as in embodiment 22, with the exception that this sheet material 5 was used in place of the sheet material 1.

With respect to the execution properties, resin liquid 1 impregnated easily into sheet material 5. Furthermore, resin liquid 1 cured completely after a period of 30 minutes, and even at low temperature (5° C.), the curing was completed after a period of 1 hour, and sufficient elasticity and strength were exhibited.

The adhesion with the concrete was good, and when a bonding test by the Building Research Institute method was conducted after one hour of resin curing at the standard temperature, the strength was found to be 45 kg/cm$^2$ (4.4 MPa), and the breakage was within the concrete.

The results of a bending test and a compression test were that the bending strength was 125 kg/cm$^2$ (12.3 MPa), while the compressive strength was 532 kg/cm$^2$ (52.2 MPa).

Embodiment 27

A resin was prepared in the following manner: first, one part of n-paraffin (having a melting point within a range of 54–56° C.) was added as a paraffin wax to component (1) comprising 51 parts of methyl methacrylate, 20 parts of n-butyl methacrylate, and 3 parts of ethylene glycol dimethacrylate, and this mixture was heated to 50° C. and mixed, and during this process, a component (2) comprising 24 parts of an acrylic copolymer having an average molecular weight of 95,000 and comprising methyl methacrylate and methyl acrylate in a ratio of 97/3 (by weight) was added and dissolved therein, and thereafter, one part of N,N-dimethyl-p-toluidine was added while cooling as a curing promoter, and the resin liquid was obtained. The viscosity thereof at 20° C. was found to be 700 centipoise.

Two parts of benzoyl peroxide diluted to 50% in a plasticizer was added per 100 parts of the above resin liquid, and this was used hereinbelow (this is termed resin liquid 2).

The execution properties and reinforcement effects were assessed in the same manner as in embodiment 22, with the exception that this resin liquid 2 was used in place of the resin liquid 1.

Resin liquid 2 impregnated easily into sheet material 1. Furthermore, resin liquid 2 was completely cured after a period of 30 minutes, and even at low temperatures (5° C.), the curing was complete after a period of one hour, and sufficient elasticity and strength were exhibited. The bonding strength to the concrete was good, and when a bonding test by the Building Research Institute method was conducted after a period of one hour of resin curing at the standard temperature, the strength was found to be 47 kg/cm$^2$ (4.6 MPa), and the breakage occurred within the concrete.

The results of the bending test and the compression test were that the bending strength was 164 kg/cm$^2$ (16.1 MPa) and the compression strength was 550 kg/cm$^2$ (53.9 MPa). The proportion of resin contained in the repair and reinforcement layer was 63 weight percent.

Comparative Example 7

60 parts of bisphenol A type epoxy resin (Ep 828, produced by Yuka Shell Epoxy Corporation), 40 parts of trimethylolpropane triglycidyl ether (Adeka Glycerol ED-505, produced by Asahi Denka Industries) and 45 parts of an aliphatic polyamine modified curing agent (Ancamine 2021, produced by ACI Japan) were mixed, and thereby a room-temperature-curing-type epoxy system resin liquid 3 (5700 centipoise at 20° C. using a B type viscometer) was obtained.

The execution properties and reinforcement effects were assessed in the same manner as in embodiment 22, with the exception that this epoxy system resin liquid 3 was used in place of the resin liquid 1.

It was difficult to impregnate resin liquid 3 into sheet material 1. Furthermore, although the stickiness of the resin liquid 3 disappeared after it was allowed to stand at the standard temperature for half a day, the elasticity and strength thereof were poor, and a period of 7 days was required before sufficient elasticity and strength were obtained. Furthermore, at low temperatures, 5 days were required for the stickiness thereof to disappear, and 20 days were required to exhibit sufficient elasticity and strength, and the adhesion strength with the concrete was poor, so that when an adhesion test was conducted after the passage of half a day at the standard temperature, the strength was 39 kg/cm$^2$ (3.8 MPa), and breakage occurred at the interface between the concrete and the sheet material comprising strengthening fibers.

The results of a bending test and a compression test conducted on a test piece which was allowed to completely cure at standard temperatures resulted in a bending strength of 164 kg/cm$^2$ (16.1 MPa) and a compression strength of 540 kg/cm$^2$ (53.0 MPa).

Comparative Example 8

Pyrofil TR- 30G carbon fibers (having a filament count of 12000) produced by Mitsubishi Rayon Co. Ltd. were disposed so as to have a spacing of 2.5 mm in an arranged manner on a resin film, in which a bisphenol A type epoxy resin (Ep 834, produced by Yuka Shell Epoxy Corporation) was applied on release paper at a weight of 30 g/m$^2$, and by applying heat pressing, the resin was impregnated into the carbon fibers, and a sheet material 6 comprising reinforcement fibers was obtained.

The execution properties were assessed in the same manner as in embodiment 22, with the exception that this sheet material 6 was employed in place of sheet material 1.

With respect to the execution properties, resin liquid 1 impregnated into sheet material 6; however, this caused great drift and disorder in the carbon fibers. Furthermore, the surface of resin liquid 1 was free of sticking after 30 minutes at standard temperatures, but the interface between the sheet material and the concrete, and the interior of the sheet material, were not cured, and these areas remained uncured even after the passage of 5 days.

Embodiment 28

As a sheet material comprising reinforcement fibers, Pyrofil TR- 30G carbon fibers (having a filament count of 12000) produced by Mitsubishi Rayon Co. Ltd. were arranged using a batten in a single direction at a width of 300 mm and spacing of 2.5 mm, and heat-fusible fibers, resulting from the twining of long glass fibers ECD450, 1/2 (having a TEX number of 22.5) and low melting point nylon (polyamide) filaments (having a melting point of 125° C.) of 50 deniers, were plain woven with a spacing of 10 mm in a direction perpendicular to that of the carbon fibers, and thereafter, this was passed through heating rollers at a temperature of 180° C. and at a pressure of 1 kg/cm$^2$ (0.1 Mpa) for a period of 40 seconds, and a sheet material 1 (anisotropic textile) comprising reinforcement fibers having a carbon fiber weight of 300 g/m$^2$ was obtained, and this was taken up on a paper roller.

The preparation of the resin was as follows: first, one part of n-paraffin (having a melting point within 54–56° C.), as a paraffin wax, and 1 part of γ-methacryloxypropyl trimethoxysilane, as a silane coupling agent, were added to component (1) comprising 60 parts of methyl methacrylate, 10 parts of 2-ethylhexyl acrylate, and 2 parts of 1,3-butylene glycol dimethacrylate, and this was heated to 50 ° C. while mixing, and during this process, a component (2) comprising 25 parts of an acrylic copolymer having an average molecular weight of 42000 and comprising methyl methacrylate and n-butyl methacrylate in a ratio of 60/40 (by weight) was dissolved therein, and while cooling this, two parts of N,N-dimethyl-p-toluidine was added as a curing promoter, and a resin liquid A1 was obtained. The viscosity thereof at 20° C. was found to be 80 centipoise.

Instead of adding two parts of N,N-dimethyl-p-toluidine while cooling, four parts of benzoyl peroxide diluted to 50% in a plasticizer was added as an organic peroxide to 100 parts of the resin liquid after cooling, and a resin liquid B1 was thus prepared.

The viscosity thereof at 200° C. was found to be 85 centipoise.

Both resin liquids exhibited almost no change in viscosity even when allowed to stand for one week at the standard temperature, and thus exhibited sufficient stability.

Using a doctor coater, resin liquid Al was coated on release paper so to reach a resin weight of 200 g/m$^2$, and the sheet material I comprising reinforcement fibers which was described above, and a separated piece of paper, were placed there on, and a prepreg A1 was obtained by subjecting this to pressure using rubber rollers at room temperature.

Resin liquid B1 was first sufficiently applied using a brush to the concrete surface, and then the prepreg A1 described above was laid thereon with the release paper removed, and after that, resin liquid B1 was applied thereon to the entire surface of the prepreg using a roller, and this was allowed to impregnate and mix well. The prepreg was cured by being allowed to stand for a period of 30 minutes at room temperature (23° C.). A portion of the cured prepreg was subjected to a bonding test by the Building Research Institute method in which this portion was stripped from the concrete, in accordance with JIS A6909. A strength of 800 kg/1600 mm$^2$ (50 kg/cm$^2$, 4.9 MPa) was obtained, and the prepreg was stripped off along with concrete, so that sufficient curing properties and adhesive properties were obtained. Furthermore, sufficient reinforcement strength was exhibited. The proportion of resin present in the repair and reinforcement layer was 57 weight percent.

Embodiment 29

Glass fibers (having a tensile elastic modulus of 72.5 GPa, a melting point of 840° C., and a specific gravity of 2.54 g/cm$^3$) having a TEX number of 22.5 (0.0225 g/m) were twined together with low melting point polyamide multifilaments (having a melting point of 125° C. and a specific gravity of 1.08 g/cm$^3$) having a total denier of 70 deniers, and an ethylene vinyl acetate copolymer (having a melting point of 80° C.) was deposited thereon in an amount of 1.5 g per 1000 m of the twined thread, to produce a composite thread. The weight per meter of this composite thread was approximately 0.03 g, and the composite ratio between the high melting point fibers and the low melting point fibers was 1:0.8 in volumetric ratio.

Using Pyrofil TR 30G carbon fibers (having a tensile strength of 4.5 GPa, a tensile elastic modulus of 235 GPa, and a filament count of 12000) produced by Mitsubishi Rayon Co. Ltd. arranged so that the fiber weight was 300 g/m$^2$ as the warp, and using the composite thread described above as the weft, weaving was conducted so that the weft spacing was 5 mm, and by passing this textile through a pair of rollers heated to a temperature of 180° C., the warp and weft partially adhered to one another, and a sheet material comprising reinforcement fibers (the anisotropic textile of the present invention) was obtained.

70 parts of methyl methacrylate, two parts of 1,3-butylene glycol dimethacrylate, 25 parts of n-butyl acrylate macromonomer having a number average molecular weight of 6,000 and possessing a methacrylic group on the terminus thereof, one part of n-paraffin, and one part of γ-methacryloxypropyl trimethoxysilane, were sufficiently mixed so as to become uniform, and two parts of N,N, dimethyl-p-toluidine were added thereto and mixed, and thus a resin liquid A containing a curing promoter but not containing a curing agent, was obtained. The viscosity of the resin at 20° C. was 75 centipoise.

Furthermore, a resin liquid B containing a curing agent (an organic peroxide) but not containing a curing promoter was obtained by adding, in place of the two parts of N,N-dimethyl-p-toluidine, four parts of benzoyl peroxide. The viscosity of the resin at 20° C. was found to be 75 centipoise.

Resin liquid A was applied to the surface of a concrete bending test piece in accordance with JIS A1132 to which the sheet material comprising reinforcement fibers was to be applied, using a pile roller (the roller having the brand name 'Uu Roller' produced by Otsuka Brush Mfg. Corporation) so as to reach a level of 125 g/m$^2$, and then the sheet material comprising reinforcement fibers was affixed to the concrete test piece so that the longitudinal direction of the concrete test piece coincided with the direction of orientation of the reinforcement fibers, and then the sheet material comprising reinforcement fibers was lightly pressed into the surface to which the resin liquid A had been applied, so that resin liquid A was lightly impregnated. On top of this, resin liquid B was applied using a pile roller so as to reach a level of 250 g/m$^2$, and this was impregnated into the sheet material comprising reinforcement fibers. Resin liquid A was then applied using a pile roller to the surface to which the resin liquid B had been applied so as to reach a level of 125 g/m$^2$, and finally the impregnation and mixing of both these liquids was promoted using a grooving roller, and this was then allowed to stand. Resin liquid A and resin liquid B were both independently stable at the standard temperature; however, after mixing, the reaction rapidly progressed, and curing took place after approximately 30 minutes. Both resin liquid A and resin liquid B impregnated easily into the sheet material comprising reinforcement fibers, and the operation proceeded smoothly, so that a single person was easily able to complete the operation of affixing the material to 20 concrete test pieces with a single round of resin preparation. Curing was complete within approximately one hour from the application of resin liquid B, and confirmation of this surface by touching revealed no curing deficiencies. The bonding to the concrete was evaluated using the Building Research Institute method after a period of one and half hours, and breakage was found to occur within the concrete portion, so that it was confirmed that sufficient bonding strength was obtained.

Next, bending tests were carried out in accordance with JIS A1106, and the reinforcement strength was confirmed. The bending strength was 90 kgf/cm$^2$ (8.8 MPa) when no reinforcement was carried out, while when reinforcement was carried out, this strength rose to 160 kgf/cm$^2$ (15.7 MPa).

Embodiment 30

Test pieces were produced and evaluated in the same manner as in embodiment 29, with the exception that the affixing operation to the concrete bending test pieces was carried out under conditions such that the temperature was 5° C. Even at 5° C., curing was sufficient after a period of 2 hours, and no curing deficiencies could be found by touch. In the bonding test, the presence of breakage within the concrete was confirmed. Furthermore, the bending strength was 158 kgf/cm$^2$ (15.5 MPa), so that it was determined that sufficient reinforcement effects were exhibited even at low temperatures.

Embodiment 31

In the same manner as in embodiment 29, a sheet material comprising reinforcement fibers (the anisotropic textile of the present invention), and a resin liquid A and a resin liquid B, were prepared.

The resin liquid A described above was applied to the surface of concrete test pieces in accordance with JIS A1132 to which the sheet material comprising reinforcement fibers was to be affixed, using a pile roller and so as to achieve a level of 125 g/m$^2$, and the sheet material comprising reinforcement fibers was affixed to the concrete test pieces so that the longitudinal direction of the test pieces coincided with the direction of orientation of the reinforcement fibers, and the sheet material comprising reinforcement fibers was lightly impregnated with resin liquid A. Then on top of this, resin liquid B was applied in an amount of 250 g/m$^2$, and this was allowed to impregnate into the sheet material comprising reinforcement fibers, and furthermore, resin liquid A was applied in an amount of 250 g/m$^2$ to the surface to which this resin liquid B had been applied, and a sheet material comprising reinforcement fibers was affixed to the concrete test piece so that the longitudinal direction of the concrete test piece coincided with the direction of orientation of the reinforcement fibers, and resin liquid A was lightly impregnated into the sheet material comprising reinforcement fibers. Next, on top of this, resin liquid B was applied in a similar manner in an amount of 250 g/m$^2$, and this was allowed to impregnate into the sheet material comprising reinforcement fibers, and then resin liquid A was applied in an amount of 125 g/m$^2$ in the same manner to the surface to which the resin liquid B had been applied, and the impregnation and mixing thereof was promoted using a grooving roller, and this was then allowed to stand. Resin liquid A and resin liquid B were both independently stable at the standard temperature; however, after mixing, the reaction therebetween proceeded rapidly, and curing occurred after approximately 30 minutes.

Resin liquid A and resin liquid B both impregnated easily into the sheet material comprising reinforcement fibers, and the operation proceeded comparatively smoothly, so that the affixing operation onto 6 concrete test pieces presented no problems.

The curing was completed in approximately 20 minutes from the application of resin liquid B, and no spots at which curing was deficient could be confirmed by touch. The bonding to the concrete was tested by the Building Research Institute method after 1½ hours, and breakage was determined to occur in the concrete portion, so that it was confirmed that sufficient bonding strength was obtained.

Embodiment 32

Pyrofill TR- 30G carbon fibers (having a filament count of 12000) produced by Mitsubishi Rayon Co. Ltd. were arranged unidirectionally in sheet form using a batten and a comb and having a width of 300 mm and spacing of 2.5 mm; and Daiamid spans (having a weight of 13 g/m$^2$) produced by Daicel-Huls Ltd. were disposed on both surfaces thereof as heat-fusible non-woven fabrics, and this was passed through heated rollers at a temperature of 130 ° C. and a pressure of 1 kg/cm$^2$ for a period of 40 seconds, the heat-fusible non-woven fabric was melted and caused to adhere the carbon fibers, and thereby, a sheet material 5 comprising reinforcement fibers was obtained in the same manner as in embodiment 26.

The affixing of the sheet material onto concrete test pieces was conducted in the same manner as in embodiment 29, with the exception that this sheet material 5 comprising reinforcement fibers was employed as the sheet material comprising reinforcement fibers. The operation of affixing this sheet material to 20 concrete test pieces was easily completed. Curing was completed within approximately 1 hour from the application of resin liquid B, and no spots at which curing was deficient were revealed by touch. The bonding to the concrete was evaluated using the Building Research Institute method after 1½ hours, and breakage was found to occur within the concrete, so that it was confirmed that sufficient bonding strength was obtained.

Embodiment 33

In the sheet material comprising reinforcement fibers of embodiment 28, the spacing of the heat-fusible fibers was set to 5 mm, and a sheet material II comprising reinforcement fibers (the anisotropic textile of the present invention) was obtained.

30 m of this sheet material II comprising reinforcement fibers was measured, and this was wound around a paper tube of 15.4 cmϕ.

The paper tube having the sheet material II comprising reinforcement fibers described above wound therearound was placed in a stainless steel container, and the resin liquid A1 of embodiment 28 was poured over this from above, so that the resin was placed in the container, this was sealed, and the resin was allowed to impregnate into the sheet material II comprising reinforcement fibers. This was allowed to impregnate sufficiently by allowing the container to stand for a period of 2 days at room temperature.

After impregnation, the roller containing the sheet material II comprising reinforcement fibers, containing sufficient resin liquid A1, was retrieved from the stainless steel container, and excess resin was removed by light squeezing between rubber rollers, and the prepreg A2 was thus obtained.

The resin liquid B1 of embodiment 28 was first sufficiently applied to the concrete surface using a brush, and then the prepreg A2 described above was laid on top of this, wherein after resin liquid B1 was applied over the entire surface of prepreg A2 using a brush and a roller, and allowed to soak in. The prepreg was cured by means of being to stand at room temperature (23° C.) for 30 minutes.

A Building Research Institute type bonding test was conducted in which a portion of the cured prepreg was stripped from the concrete in accordance with JIS A6909. A strength of 783 kg/1600 $mm^2$ (49 $kg/cm^2$,4.8 MPa) was obtained, and concrete was stripped off along with the prepreg, so that sufficient curing properties and bonding properties were obtained. Furthermore, sufficient reinforcement strength was exhibited. The proportion of resin contained in the repair and reinforcement layer was 62 weight percent.

Comparative Example 9

A mixed resin containing 50 parts per weight of Epikote 828 (produced by Yuka Shell Epoxy Corporation) and 50 parts per weight of ED505 (produced by Asahi Denka Corporation) was used in place of the resin liquid A1 of embodiment 28, and a prepreg (having a resin content of 40%) was obtained in the same manner as in embodiment 28.

1 part per weight of a mercaptan system curing agent (Capcure WR-6, produced by Yuka Shell Corporation) and 0.5 parts per weight of tris(dimethylaminomethyl) phenol (Epicure 3010, produced by Yuka Shell Corporation) as a curing promoter were dissolved in 1 part per weight of acetone, and this curing agent solution was applied to the surface of concrete which had been treated with a primer, and then the prepreg described above was placed thereon, and the curing agent solution was again applied thereto. This was dried and cured at room temperature (20° C.); however, the prepreg remained uncured even after the passage of 12 hours. After the passage of 5 days, there was no longer any surface stickiness, so that a bonding test by the Building Research Institute method was conducted. The prepreg peeled away at the inner face with the concrete, and the strength thereof was 125 kg/1600 $mm^2$ (8 $kg/cm^2$, 0.8 MPa), so that curing was insufficient.

Embodiment 34

The sheet material I comprising reinforcement fibers of embodiment 28 was covered with N,N-diisopropyl-p-toluidine powder in an average amount of 10 $g/m^2$ as a curing promoter, and thereby, a sheet material Ia comprising reinforcement fibers on which a curing promoter was deposited was obtained.

The resin liquid B1 of embodiment 28 was first sufficiently applied to a concrete surface using a brush, and then, the sheet material 1A comprising reinforcement fibers on which curing promoter was deposited was placed thereon, and after this, resin liquid B1 of embodiment 28 was again applied over the entire surface of the sheet using a roller. The resin was cured by allowing this to stand for 30 minutes at room temperature (23° C.).

A bonding test by the Building Research Institute method in which a portion of the sheet material comprising reinforcement fibers which was cured was stripped from the concrete, in accordance with JIS A6909, was conducted, and it was determined that the strength was 780 kg/1600 $mm^2$ (49 $kg/cm^2$, 4.8 MPa) , and the concrete was stripped away together with the reinforcement fibers, so that sufficient curing properties and bonding properties were obtained, and sufficient reinforcement strength was exhibited. The proportion of resin contained in the repair and reinforcement layer was 58 weight percent.

Embodiment 35

41.7 parts of Epikote 1004 (produced by Yuka Shell Epoxy Corporation) were added to 20 parts of methyl methacrylate containing a polymerization inhibitor, and this was heated to a temperature of 80° C. and dissolved, and thereafter, 0.8 parts of triethyl amine was added as a reaction catalyst, and this was allowed to react for a period of 8 hours while adding 35 parts of methacrylic acid by dripping, and an epoxy methacrylate resin solution having an acid number of 5 was obtained. To this resin solution was added 32 parts of methyl methacrylate, 1 part of γ-methacryloxypropyl trimethoxysilane, and 1 part of n-paraffin, and this was allowed to dissolve, and was then cooled, and 4 parts of benzoyl peroxide (diluted to 50% with a plasticizer) was added, to produce resin liquid B2. The viscosity of this resin liquid B2 at 20° C. was measured and found to be 220 centipoise. N,N-diethyl-p-toluidine liquid was sprayed onto a sheet material I identical to that used in embodiment 28 in an average amount of 10 $g/m^2$ as a curing promoter, and thereby, a reinforcement fiber sheet material Ib on which a curing promoter was deposited was obtained.

First, resin liquid B2 was sufficiently applied to a concrete surface using a brush, and on this, the sheet material Ib comprising reinforcement fibers on which a curing promoter was deposited was laid, and resin liquid B2 was again applied to the entire surface of the sheet using a roller. The resin was cured by being allowed to stand for 30 minutes at a room temperature of 20° C.

A bonding test by the Building Research Institute method in which a portion of the cured reinforcement fibers was stripped from the concrete was conducted in accordance with JIS A6909, and the strength was found to be 670 kg/1600 $mm^2$ (42 $kg/cm^2$, 4.1 MPa), and concrete was stripped along with the reinforcement fibers, so that sufficient curing properties and bonding properties were exhibited. The proportion of resin contained in the reinforcement layer was 52 weight percent.

Embodiment 36

2 parts per weight of Permec N (55% methylethylketone peroxide) produced by Nippon Oil Company, Ltd. was mixed with 100 parts per weight of Prominate P-991, an unsaturated polyester resin produced by Takeda Chemical Industry Ltd., and a resin liquid A was thus prepared. The viscosity of the resin at 20° C. was found to be 700 centipoise.

1 part per weight of 6% cobalt naphthenate was added to 100 parts per weight of Prominate P-991, and a resin liquid B was thus prepared. The viscosity of the resin at 20° C. was found to be 700 centipoise.

The resin liquid A obtained was placed in one tank, and the resin liquid B was placed in the other tank, of a two liquid airless coater APW-1200 (produced by Asahi Sanak Corporation) having a mixing ratio of 1 to 1 and equipped with a compressor, the air pressure thereof was set to 3 kg/cm$^2$, and the resin liquid A/B mixed by a static mixer was applied in an amount of 250 g/m$^2$ to the surface of concrete bending test pieces in accordance with JIS A1132 to which a sheet material comprising reinforcement fibers was to be applied, using an airless roller handgun, the sheet material comprising reinforcement fibers (the anisotropic textile of the present invention) of embodiment 29 was applied thereto, and after eliminating the air present in the sheet material using a defoaming roller, the mixed resin liquid A/B was applied using an airless roller handgun in an amount of 250 g/m$^2$, and the resin liquid A/B was then sufficiently impregnated using the defoaming roller again, and this was allowed to stand. The reaction proceeded rapidly and curing occurred within approximately 30 minutes.

Embodiment 37

70 parts of methyl methacrylate, 2 parts of 1,3-butylene glycol dimethacrylate, 25 parts of N-butylacrylate macromonomer having a number average molecular weight of 6,000 and having a methacrylic group on the terminus thereof, 1 part of n-paraffin, and 1 part of γ-methacryloxypropyl trimethoxysilane was mixed so as to be uniform, and a resin composition was thus obtained. 2 parts of benzoyl peroxide diluted to 50% in a plasticizer was added to this resin composition, and this was mixed to produce a resin liquid A.

1 part of N,N-dimethyl-P-toluidine was added to the same resin composition, and a resin liquid B was obtained. The resin liquid A obtained was placed in one tank, and the resin liquid B obtained was placed in the other tank, of a two liquid airless coater APW-1200 (produced by Asahi Sanak Corporation) having a mixing ratio of 1 to 1 and provided with a compressor, the air pressure thereof was regulated to 3 kg/cm$^2$, and the resin liquid A/B mixed by the static mixer was applied in an amount of 250 g/m$^2$ to the surface of concrete bending test pieces in accordance with JIS A1132 to which a sheet material comprising reinforcement fibers was to be applied, the sheet material comprising reinforcement fibers (the anisotropic textile of the present invention) of embodiment 29 was applied thereto, and the air present in the sheet material was removed using a defoaming roller, and thereafter, the mixed resin liquid A/B was applied thereon using an airless roller handgun in an amount of 250 g/m$^2$, and the resin liquid A/B was impregnated somewhat using a defoaming roller, and this was allowed to stand. The reaction proceeded quickly and curing occurred in approximately 30 minutes.

INDUSTRIAL APPLICABILITY

As described in detail above, in the repair and reinforcement method in accordance with the present invention, when resin is impregnated into a sheet material comprising reinforcement fibers and this resin is cured to form a fiber-reinforced resin layer which is used to repair and reinforce preexisting structures, a reactive mixture having a gelling time of 15 minutes or more at 25° C. and which polymerizes even at 5° C. and cures in 6 hours or less, and which, moreover, has as the chief components thereof a monomer containing vinyl groups and a reactive oligomer containing vinyl groups and/or a thermoplastic polymer, is used as the resin, so that execution is possible even under low temperature conditions, and superior repair and reinforcement effects are exhibited in a short period of time. Accordingly, this may be used as a repair and reinforcement method for preexisting structures such as bridges, bridge piers, columns, building, and the like.

Furthermore, the anisotropic textile of the present invention has superior handling properties and resin impregnation properties, and generates superior strength when cured, so that it may be employed in the repair and reinforcement of preexisting structures.

What is claimed is:

1. A method of repairing and reinforcing a preexisting structure, comprising the steps of:

providing a reactive mixture which comprised as its chief components (1) a monomer having vinyl groups an (2) a reactive oligomer having vinyl groups and/or a thermoplastic polymer and has a gelling time of 15 minutes or more a 20° C., the polymerization of which is capable of being initiated even at a temperature of 5° C. and which is curable in a period of time of 6 hours or less, even at a temperature of 5° C.;

applying the reactive mixture to the preexisting structure while impregnating a sheet material comprising reinforcement fibers with the applied mixture at a temperature at the place of use; and curing the reactive mixture to form a fiber-reinforced resin layer.

2. The method of claim 1, wherein the reactive mixture contains a component (1) comprising at least one type of (meth)acrylate monomer, and a component (2) comprising a reactive oligomer having at least 1 (meth)acrylic group within the molecule and/or a thermoplastic polymer.

3. The method of claim 2, wherein the reactive oligomer contained in the reactive mixture as component (2) comprises a reactive oligomer having at least one (meth)acrylic group and allyl ether group in the molecule.

4. The method of claim 3, wherein the reactive oligomer contained in the reactive mixture as component (2) comprises a polyester (meth)acrylate containing allyl ether groups which is obtained by the reaction of a polybasic acid, a polyhydric alcohol, an alcohol containing allyl ether groups, and (meth)acrylic acid.

5. The method of claim 3, wherein the reactive oligomer contained in the reactive mixture as component (2) comprises an epoxy (meth)acrylate containing allyl ether groups which is obtained by the reaction of a polybasic acid, an epoxy resin, an alcohol containing allyl ether groups, and (meth)acrylic acid.

6. The method of claim 5, wherein phthalic acid is the polybasic acid, bisphenol A and/or bisphenol F epoxy resin having an epoxy equivalent of 970 or less is the epoxy resin, and pentaerythritol triallylether is the alcohol containing allyl ether groups.

7. The method of claim 2, wherein the reactive oligomer contained in the reactive mixture as component (2) comprises an epoxy (meth)acrylate obtained by the reaction of an epoxy resin and (meth)acrylic acid.

8. The method of claim 2, wherein the reactive mixture has a viscosity of 5–10$^4$ centipoise at 20° C.

9. The method of claim 2, wherein the reactive mixture has a viscosity within a range of 5–800 centipoise at 20° C.

10. The method of claim 2, wherein the reactive mixture contains paraffin wax.

11. The method of claim 1, wherein an organic peroxide which is individually stable at room temperature (the temperature at the place of use or the like), and a curing promoter which makes possible the breakdown of this organic peroxide at room temperature, are added to the reactive mixture.

12. The method of claim 11, wherein a reactive mixture in which the organic peroxide and the curing promoter are uniformly mixed is applied to a surface of a portion on which repair and reinforcement is to be conducted;

the sheet material comprising reinforcement fibers is applied to the surface to which the reactive mixture has been applied; and the same mixture is impregnated from the opposite side and allowed to cure.

13. The method of claim 11, wherein a reactive mixture (A) containing the organic peroxide but not containing the curing promoter is mixed with a reactive mixture (B) containing the curing promoter but not containing the organic peroxide, and the mixture obtained is applied to a surface of a portion on which repair and reinforcement is to be conducted;

the sheet material comprising reinforcement fibers is applied to the surface to which the reactive mixture has been applied; and a reactive mixture (A) containing the organic peroxide but not containing the curing promoter is mixed with a reactive mixture (B) containing the curing promoter but not containing the organic peroxide, and the mixture obtained is applied to an outer surface of the sheet material and allowed to cure.

14. The method of claim 11, wherein a first mixture (A) containing the organic peroxide but not containing the curing promoter and a reactive mixture (B) containing the curing promoter but not containing the organic peroxide, is applied to a surface of a portion on which repair and reinforcement is to be conducted;

the sheet material comprising reinforcement fibers is applied to the surface to which one reactive mixture has been applied; and a second mixture, which is the other of the reactive mixture (A) or the reactive mixture (B), is impregnated into the sheet material thereby resulting in contact and mixing of the reactive mixture (A) and the reactive mixture (B), and the mixture obtained of the reactive mixture (A) and the reactive mixture (B) is allowed to cure.

15. The method of claim 11, wherein a compound (a), which is one of the organic peroxide and the curing promoter, is deposited in advance on the sheet material comprising reinforcement fibers; and during execution, a mixture containing the other of the organic peroxide or the curing promoter, but not containing the compound (a), is impregnated into the sheet material and allowed to cure.

16. The method of claim 11, wherein a first mixture, which is one of a reactive mixture (A) containing the organic peroxide but not containing the curing promoter and a reactive mixture (B) containing the curing promoter but not containing the organic peroxide, is applied to a surface of a portion on which repair and reinforcement is to be conducted;

the sheet material comprising reinforcement fibers is applied to the surface to which the first reactive mixture has been applied;

a second mixture, which is the other of the reactive mixture (A) or the reactive mixture (B), is impregnated into the sheet material; and the first mixture is further impregnated into the sheet material which results in contact and mixing of the reactive mixture (A) and the reactive mixture (B), and the mixture obtained of the reactive mixture (A) and the reactive mixture (B) is allowed to cure.

17. The method of claim 1, wherein the sheet material comprising reinforcement fibers comprises a sheet material, wherein a heat-fusible cloth is heat-fused to at least one surface of a sheet material comprising reinforcement fibers oriented in one direction.

18. The method of claim 1, wherein the sheet material comprising reinforcement fibers comprises a sheet material, in which heat-fusible fibers are disposed at at least one surface of a sheet material comprising reinforcement fibers oriented in a single direction, in a direction perpendicular to that of the reinforcement fibers and with a spacing within a range of 3–15 mm in the longitudinal direction of the reinforcement fibers, and are heat-fused to this surface.

19. The method of claim 1, wherein said sheet material comprising reinforcement fibers comprises an anisotropic textile, wherein heat-fusible fibers are disposed at and heat-fused to at least one surface of a sheet material comprising reinforcement fibers oriented in one direction, oriented in a direction perpendicular to that of the reinforcement fibers and with a spacing within a range of 3–15 mm in the longitudinal direction of the reinforcement fibers.

20. The method of claim 1, wherein said sheet material comprising reinforcement fibers comprises an anisotropic textile, employing high strength and highly elastic fibers (reinforcement fibers) having a tensile strength of 3 GPa or more and a tensile elastic modulus of 150 GPa or more as the warp, the fibers having a tensile elastic modulus lower than that of the warp as the weft, wherein the weft threads comprise composite threads having a weight of 0.1 g or less per meter and comprising two types of fibers having a melting point difference of 50° C. or more, and the spacing of the weft threads in the warp direction is within a range of 3–15 mm, and by means of the low melting joint fibers comprising the weft, the warp and weft adhere to one another.

21. The method of claim 1, wherein the sheet material comprises reinforcement fibers arranged in one direction and fibers disposed so as to cross the reinforcement fibers.

22. The method of claim 1, wherein the reactive mixture comprises a curing catalyst for radical polymerization at a temperature at the place of use.

23. The method of claim 1, wherein the preexisting structure is selected from the group consisting of bridges, columns, piers, and buildings.

24. The method of claim 1, wherein the preexisting structure comprises concrete.

* * * * *